US005337542A

United States Patent [19]

Omori

[11] Patent Number: 5,337,542

[45] Date of Patent: Aug. 16, 1994

[54] SHRINK-WRAPPING METHOD AND APPARATUS

[75] Inventor: Shozo Omori, Tokyo, Japan

[73] Assignee: Omori Machinery Co., Ltd., Saitama, Japan

[21] Appl. No.: 19,804

[22] Filed: Feb. 12, 1993

Related U.S. Application Data

[63] Continuation of Ser. No. 858,954, Mar. 27, 1992, Pat. No. 5,237,800.

[30] Foreign Application Priority Data

Mar. 29, 1991 [JP] Japan ..... 3-89320
Sep. 30, 1991 [JP] Japan ..... 3-86655[U]

[51] Int. Cl.[5] ..... B65B 9/06; B65B 49/10

[52] U.S. Cl. ..... 53/550; 53/374.5; 53/450

[58] Field of Search ..... 53/450, 550, 548, 477, 53/479, 371.5, 374.5, 374.3, 376.2, 375.9

[56] References Cited

U.S. PATENT DOCUMENTS

| | | | |
|---|---|---|---|
| 3,274,746 | 9/1966 | James et al. | 53/450 X |
| 3,420,034 | 1/1969 | Saraisky et al. . | |
| 3,438,173 | 4/1969 | Omori . | |
| 3,729,894 | 5/1973 | Stohlquist | 53/450 |
| 3,782,070 | 1/1974 | Erlandson | 83/326 X |
| 3,938,298 | 2/1976 | Luhman et al. | 53/450 X |
| 3,958,390 | 5/1976 | Pringle, Jr. et al. | 53/433 X |
| 4,044,524 | 8/1977 | Segale et al. | 53/450 X |
| 4,114,348 | 9/1978 | Mahaffy et al. | 53/433 |
| 4,517,786 | 5/1985 | Barker | 53/450 |
| 4,546,595 | 10/1985 | Yasumune et al. | 53/450 |
| 4,642,969 | 2/1987 | Johnson | 53/433 |
| 4,670,279 | 6/1987 | Lesch | 53/450 X |
| 4,704,843 | 11/1987 | Owen et al. | 53/450 |
| 4,964,259 | 10/1990 | Ylvisaker et al. | 53/433 |
| 5,237,800 | 8/1993 | Omori | 53/433 |

FOREIGN PATENT DOCUMENTS

| | | |
|---|---|---|
| 0368095 | 5/1990 | European Pat. Off. . |
| 3528634 | 2/1987 | Fed. Rep. of Germany . |

*Primary Examiner*—James F. Coan
*Attorney, Agent, or Firm*—Wenderoth, Lind & Ponack

[57] ABSTRACT

A thermal shrink film is continuously pulled out and is shaped into a tubular form. Individual items to be wrapped are fed into the tubular film sequentially and overlapping marginal portions of the tubular film extending lengthwise are sealed. The tubular film is sealed and cut transversely of each of the items at the front end thereof and the tubular film is deformed inwardly by applying pressure thereto to decrease its internal volume. Then the tubular film is sealed and cut transversely of each item at the rear end thereof to form an intermediate package. The film of the intermediate package is shrunk by heating to thus shrink-wrap the item.

3 Claims, 7 Drawing Sheets

SHRINK-WRAPPING METHOD AND APPARATUS

This is a continuation application of Ser. No. 07/858,954, filed Mar. 27, 1992 now U.S. Pat. No. 5,237,800.

BACKGROUND OF THE INVENTION

1. Field of the Invention

The present invention relates to a method and apparatus for shrink-wrapping items by thermally shrinking a film wrapping the items.

2. Description of the Prior Art

According to a prior art, a web of wrapping film which is thermally shrinkable is continuously pulled out from a reel and is led to a bag making unit, by which it is rendered tubular, and individual items are fed into the tube of the wrapping film. Then, opposed sheets of the tube of the wrapping film are joined in longitudinal seals along opposite marginal edges of the film and in transverse seals along the transverse ends of each item within the tube, thereby forming intermediate packages respectively containing the items within the thermal shrink film. The intermediate packages are fed through a shrinking tunnel, by which the film is heated and shrunk into close contact with the individual items contained therein. However, when the film of each intermediate package is sealed completely airtight, the air in the package is thermally expanded by the heat applied for shrinking the film. The pressure of this expanding air causes the film to swell against its shrinking force, making it impossible to shrink the film into a desired form in which the item is tightly wrapped.

A solution to this problem is to make very small perforations in the wrapping film at predetermined positions, to thus enable release of air pressure. When the intermediate package is heated, the air remaining therein is thermally expanded but does not swell the film, because the expanded air is discharged outside through the perforations. Accordingly, the film is thermally shrunk into close contact with the item and hence shrink-wraps it.

To make such perforations in the wrapping film a perforator is provided in the path along which the web of film pulled out from the reel is fed to the bag making unit. The perforator is disposed adjacent a guide roller which guides the film to the bag making unit. The perforator comprises a rod extending widthwise of the film, a plurality of rotary members mounted on the rod and a plurality of needles attached to each rotary member. By this structure, the perforations are made in the wrapping film at predetermined positions therealong while the film is transferred in contact with the rotary members.

The number and positions of such perforations to be made in the wrapping film, that is the number and positions of perforations to be made in each intermediate package, are determined according to the size of the intermediate package and the ratio in volume between the article contained therein and the internal space of the package. Hence it is necessary to adjust the number of perforations and their positions in the wrapping film in accordance with the size and shape of each article to be wrapped. Accordingly, the conventional shrink-wrapping apparatus calls for time-consuming and cumbersome operations such as selection or exchange of the above-mentioned rotary members and adjustment of the relative angular positions of the perforating needles between the rotary members each time the size and shape of the article to be wrapped are changed.

Moreover, the shrink package itself obtained with the conventional shrink-wrapping apparatus has the following defect due to the perforations and hence the resultant sealing imperfect.

For example, when the item to be wrapped is a plant, perishable food, or the like, it is preferable, for preserving its freshness or preventing its discoloration, that nitrogen gas, carbon dioxide, or similar inert gas is filled into the package together with the item to be wrapped. However, the conventional shrink package cannot be filled with such an inert gas. That is, the nitrogen gas or the like, even if filled into the shrink package, will flow out therefrom through the perforations, thus lessening the effect of the gas.

Besides, thermal shrink films used in the past, such as polyethylene, polypropylene, etc., do not have a very low gas permeability. Thus, nitrogen gas or similar inert gas filled into the shrink package leaks out therefrom little by little through the film, further lessening the above-mentioned effect.

SUMMARY OF THE INVENTION

It is therefore an object of the present invention to provide a method and apparatus for forming a shrink package which does not call for making perforations in the wrapping film and hence has high gas permeability.

Another object of the present invention is to provide a method and apparatus for forming a shrink package which has sufficiently in gas permeability that nitrogen gas or similar inert gas filled therein will not leak out therefrom.

To attain the above objects, a shrink-wrapping method according to the present invention includes the steps of: continuously pulling out a wrapping film made of a material which has excellent thermal shrinkage and low gas permeability properties; rendering the film in a tubular form; feeding individual items into the tubular film; sealing overlapping marginal portions of the tubular film extending lengthwise thereof; sealing the tubular film transversely of each of the items at a front end thereof and cutting the tubular film along the transverse seal; applying pressure to the tubular film to deform the tubular film inwardly to decrease the content or internal volume of the tubular film; sealing the tubular film transversely of each item at the rear end thereof and cutting the tubular film along the transverse seal to form an intermediate package with the internal volume of the tubular film maintained decreased; and heating the film of the intermediate package to thermally shrink the film thereby to shrink-wrap the item.

Preferably, another step is included which introduces an inert gas into the tubular film after it is sealed and cut along the transverse side of the item at the front end thereof.

The shrink-wrapping apparatus according to the present invention includes: means for continuously supplying a wrapping film made of a material which has excellent thermal shrinkage and low gas permeability properties; means for providing the film in a tubular form; means for feeding individual items into the tubular film; center seal means provided in a path of conveyance of the tubular film for sealing overlapping marginal portions of the tubular film extending lengthwise thereof; end seal means disposed downstream of the center seal means for sealing and cutting the tubular film transversely thereof at predetermined intervals; a shrinking tunnel disposed downstream of the end seal means for heating an intermediate package cut away from the tubular film by the end seal means; and film deforming means disposed between the end seal means and the shrinking tunnel for deforming the tubular film inwardly to decrease a content or internal volume of the tubular film.

With such a construction, the wrapping film made of a material having excellent thermal shrinkage and low gas permeability properties is continuously pulled out of a reel and is provided in a tubular form, but while the film is pulled out, no perforations are made in the film. On the other hand, individual items are fed into the tube of the wrapping film which is conveyed with the items held therein, and during such conveyance the overlapping ends of the film are sealed by the center seal means. While being further conveyed, the film tube is sealed transversely thereof at the front end of each item and then the film tube is deformed by pressuring it to reduce its internal volume, after which the film tube is sealed and cut transversely thereof at the rear end of the item contained therein to form the intermediate package. The intermediate package thus provided has its film depressed, and hence the amount of air (or gas) therein is small. Finally, the film of the intermediate package is heated, by which the film is thermally shrunk and becomes taut. At this time, the air in the intermediate package is thermally expanded, but the expanded air flows into an upper space which is newly defined as the film, once depressed, rises until it becomes taut. Consequently, the film will not swell more than a predetermined amount upon expansion of the air. In this way, the individual items are shrink-wrapped.

Since the shrink package thus formed is a completely sealed package with no perforations made therein, an inert gas, which is filled therein for the purpose of preserving the quality of the item contained therein, will not ever leak out of the package and will serve the intended purpose for a long period of time.

Other objects, features and advantages of the present invention will become more apparent from the following description taken in conjunction with the accompanying drawings.

DESCRIPTION OF THE PREFERRED EMBODIMENTS

Figure 1:
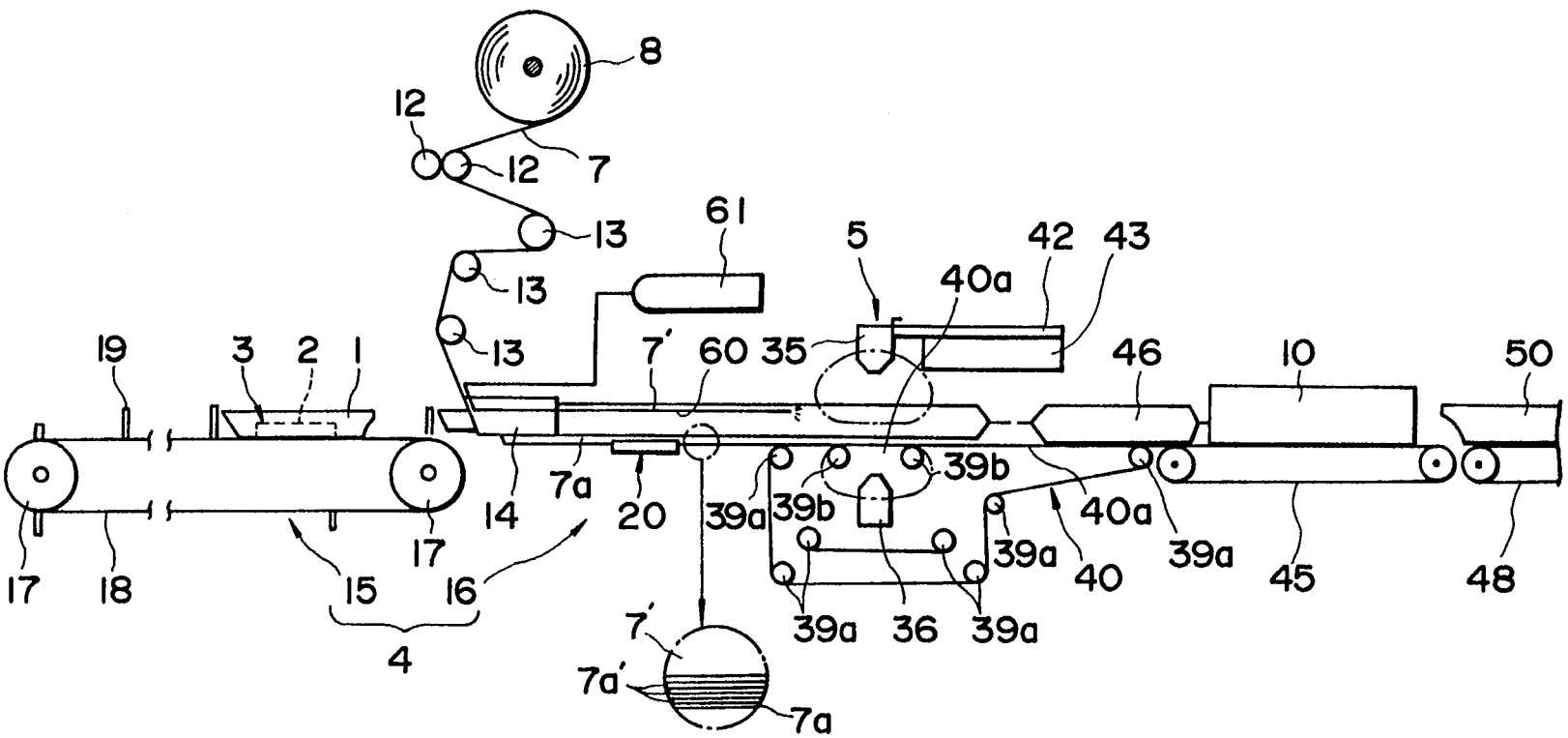
FIG. 1 is a side view schematically illustrating the overall construction of the shrink-wrapping apparatus according to a preferred embodiment of the present invention.

FIG. 1 schematically illustrates the overall structure of the shrink-wrapping apparatus according to a preferred embodiment of the present invention. As shown in FIG. 1, an end seal unit 5 is provided downstream of a conveyor unit 4 by which articles 3 to be wrapped, each of which includes a tray 1 and an item 2 contained therein, are conveyed at predetermined intervals. Disposed above the conveyor unit 4 is a reel 8 with a web of wrapping film 7 wound thereon, and disposed at the discharge end of the end seal unit 5 is a shrinking tunnel 10.

The wrapping film 7 is made of a film material which has low gas permeability, that is has the property of forming a strong gas barrier, and is highly thermally shrinkable, such as BDP-2050 (made by W. G. Grace & Co., CRYOVAC Division). The wrapping film 7 travels between a pair of pull-out rollers 12 and over a plurality of tension rollers 13 to a bag making unit 14 disposed at an intermediate position on the conveyor unit 4, by which the film 7 is folded into a tube 7' (hereinafter referred to as a tubular film 7'). The articles 3 to be wrapped are sequentially fed into the tubular film 7' while being conveyed.

The conveyor unit 4 is made up of a first conveyor 15 which conveys only the articles 3 to be wrapped and sequentially feeds them into the tubular film 7', that is serves both as a conveyor and as an infeed conveyor, and a second conveyor 16 which is disposed near the discharge end of the first conveyor 15 and conveys the articles 3 to be wrapped together with the tubular film 7'. The first conveyor 15 includes an endless chain 18 mounted on a pair of sprockets 17, and fingers 19 attached to the endless chain 18 at predetermined intervals.

The second conveyor 16 has on the underside thereof near its charging end a center seal unit 20 for sealing overlapping marginal portions *7a* of the tubular film 7'.

Figure 2:
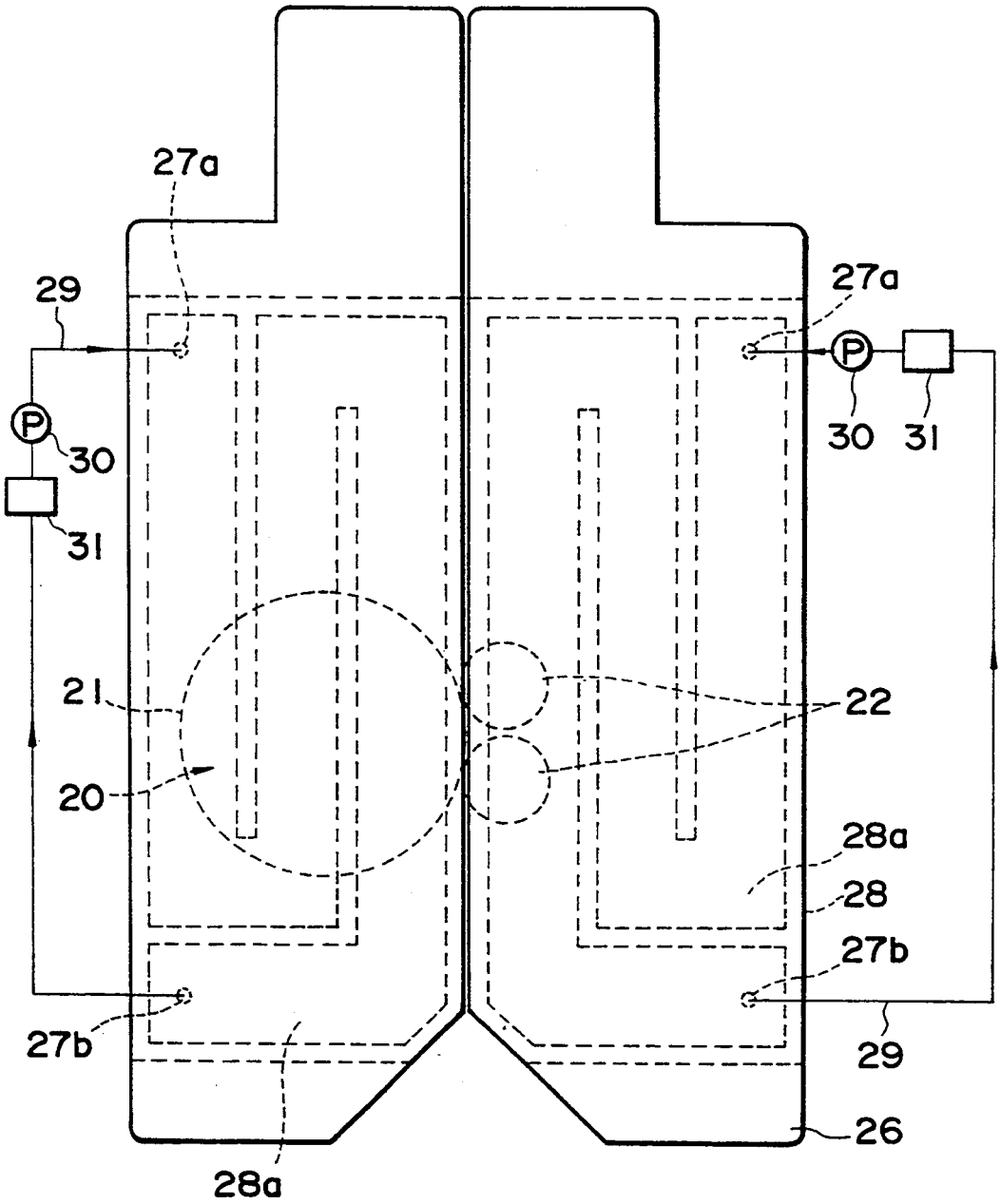
FIG. 2 is a plan view illustrating a center seal unit and its vicinity in such apparatus the embodiment, with an item to be wrapped not being shown.
Figure 3:
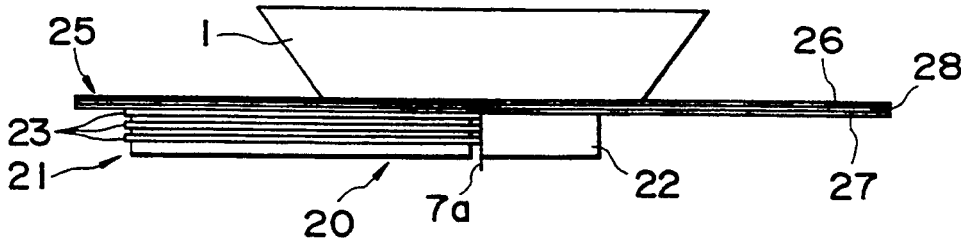
FIG. 3 is a front view of the center seal unit with the item to be wrapped being positioned thereon.

The center seal unit 20 is means by which the overlapping marginal portions *7a* of the tubular film 7' extending in its longitudinal direction are pressed together from opposite sides thereof and heated so that they are fused together. FIGS. 2 and 3 show the construction of the center seal unit 20, which comprises a heating roller 21 of a relatively large diameter and a pair of small-diametered rollers 22 disposed opposite the heating roller 21 with the overlapping marginal portions *7a* of the tubular film 7' gripped therebetween. The pair of rollers 22 are provided to ensure heat sealing of the overlapping marginal portions *7a*. The heating roller 21 has three annular projections or flanges 23 formed around its peripheral surface. The overlapping marginal portions *7a* of the tubular film 7' are held and heated between the three flanges 23 and the rollers 22 each having a flat peripheral surface to prevent the heat from being transmitted to the entire area of the overlapping marginal portions *7a*, thereby reducing the amount of heat which is transmitted to the tubular film 7'. Since the thermal shrinkage factor of the film 7 is high (about 50 to 60%), the overlapping marginal portions 7*a*, if heated too much, will shrink excessively and the sealed portion becomes so thick that a completely hermetic end seal cannot be achieved in subsequent operating steps. By suppressing the amount of heat which is transmitted to the overlapping marginal portions 7*a*, as mentioned above, the sealed portion becomes flat, thus ensuring the ability to achieve subsequent end sealing.

As a result, the overlapping marginal portions 7*a* sealed by the center seal unit 20 become a substantially flat portion having three longitudinal sealed portions 7'*a* as shown in the circle indicated by the one-dot-chain line in FIG. 1.

Moreover, in this embodiment, to prevent that portion of the tubular film 7' lying on the underside of the tray 1 from being thermally shrunk by the heat transmitted from the heating roller 21, a pair of right and left cooling plates 25 are disposed between the center seal unit 20 and the tubular film 7'. Each of the cooling plates 25 has a three-layer structure which includes flat top and bottom panels 26 and 27 and an intermediate plate 28 sandwiched therebetween and having a meandering opening or window 28*a*, thereby forming a cooling water channel. The bottom panel 27 has at a predetermined position an inlet port 27*a* for supplying cooling water to the meandering window 28*a* and an outlet port 27*b* therefrom. A pump 30 and a tank 31 are connected via pipes 29 to the inlet port 27*a* and the outlet port 27*b*. Thus, cooling water circulates through closed loops each formed by the cooling water channel, the pipes 29, the pump 30 and the tank 31. Incidentally, this embodiment uses tap water as the cooling water.

The overlapping marginal portions 7*a* of the tubular film 7' are received vertically in the gap between the two cooling plates 25 so that they are gripped between the rollers 21 and 22 lying under the cooling plates 25.

Figure 4:
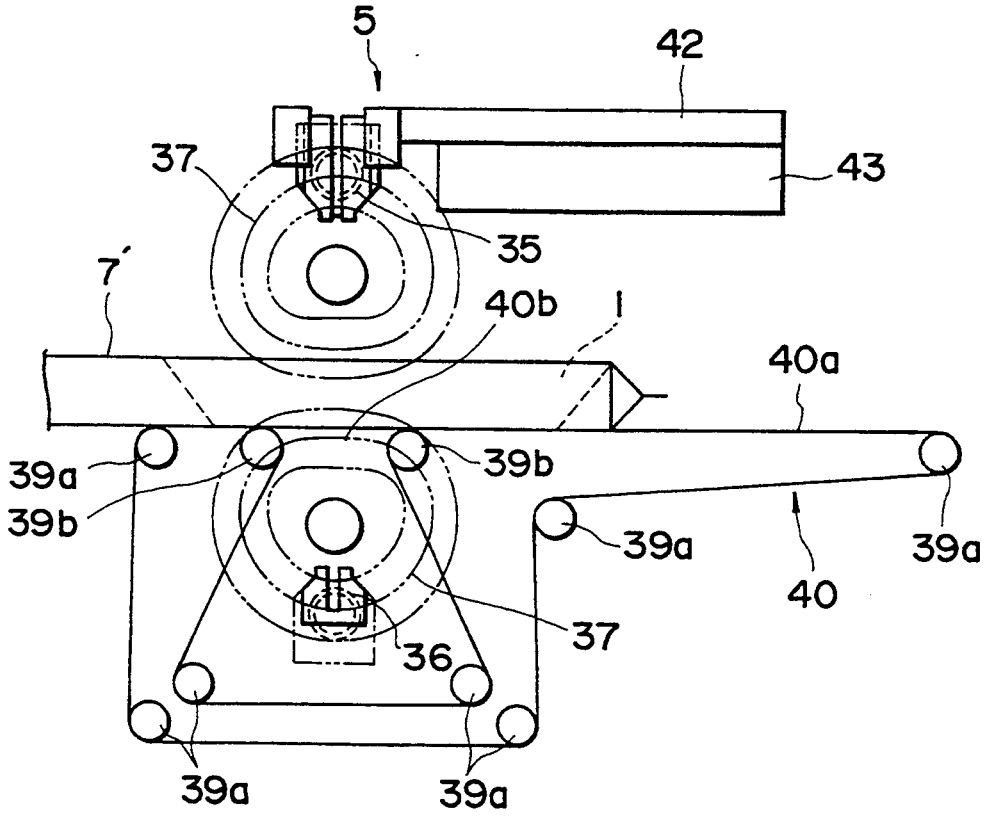
FIG. 4 is a side view showing an end seal unit composed of a pair of upper and lower end sealers and their vicinity in such apparatus.
Figure 5:
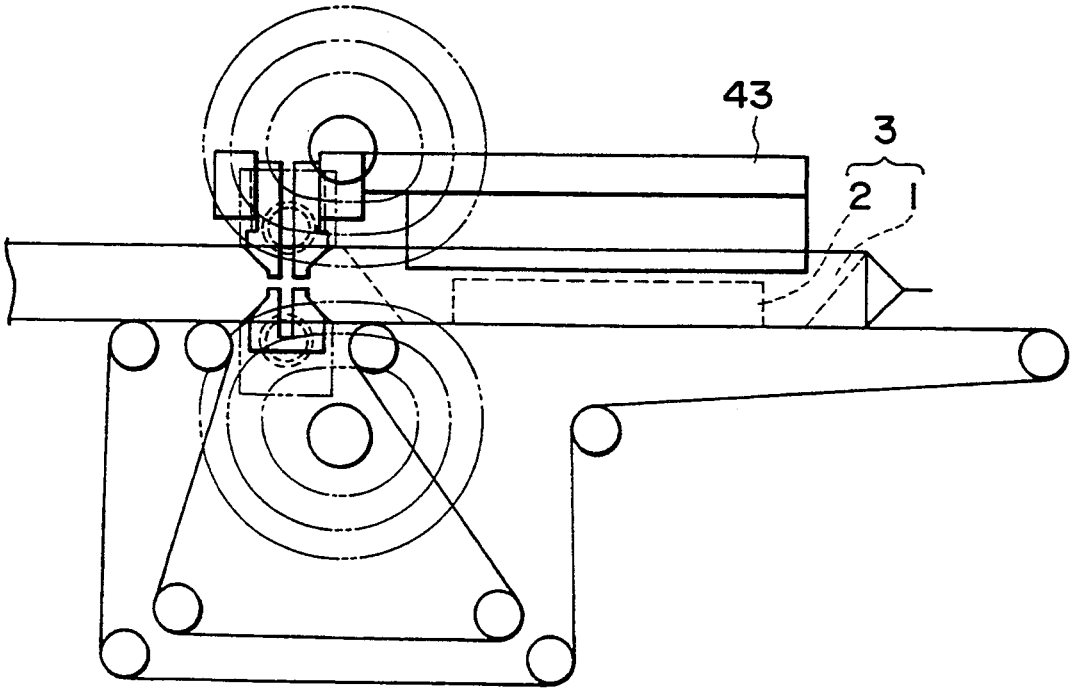
FIG. 5 is a side view showing a state in which the upper and lower end sealers have approached each other from their positions in FIG. 4.
Figure 6:
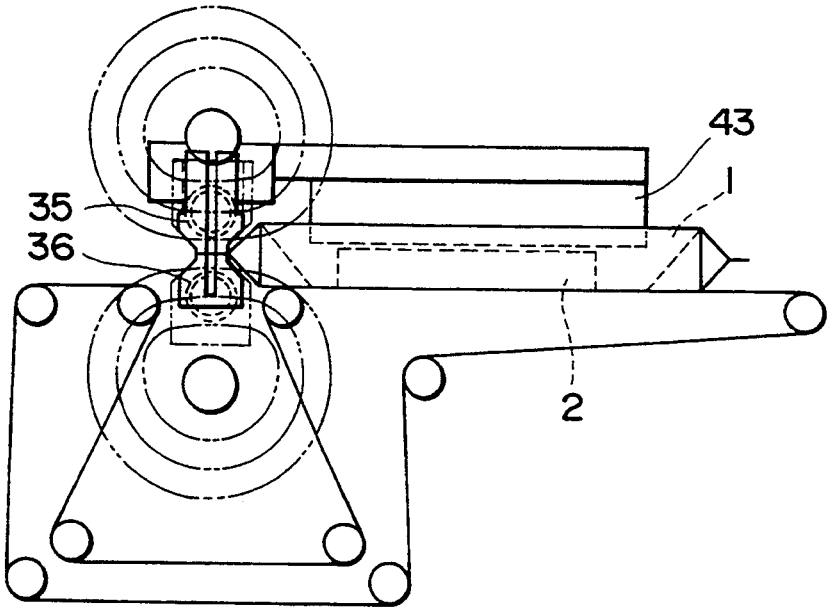
FIG. 6 is a side view showing a state in which the upper and lower end sealers have further approached each other to perform end-sealing.

The end seal unit 5 in this embodiment is termed a box motion type end seal unit and has a construction as shown in FIGS. 4 through 6. The end seal unit 5 has a pair of upper and lower end sealers 35 and 36, and the sealing surface of the upper end sealer 35 has built therein a cutting edge. The end sealers 35 and 36 are associated with respective grooved cams 37 so that the end sealers 35 and 36 move along a predetermined path within which they move forward while meshing with each other with the film 7 gripped therebetween and then move backward while moving apart from each other. Around the lower end sealer 36 there is provided an endless belt 40 which travels over plural fixed and moving pulleys 39*a* and 39*b*. The tubular film 7' is received and conveyed on the top surface 40*a* of the endless belt 40. An opening 40*b* of the endless belt 40, defined by the moving pulleys 39*b* around the lower end sealer 36*a*, moves back and forth with the lower end sealer 36 by moving the moving pulleys 39*b* back and forth in synchronism with the movement of the lower end sealer 36, by which the width of the opening 40*b* is reduced to facilitate smooth conveyance of the tubular film 7'.

In the present invention, there is provided downstream of the upper end sealer 35 of the end seal unit 5 a film press member 43 connected thereto via a coupling plate 42 for pressing and deforming the tubular film 7'. The film press member 43 is formed by a sponge having in a rectangular parallelepipedic shape and a plane area made smaller than that of the upper opening portion of the tray 1. The thickness of the film press member 43 is selected such that its underside lies below the upper edge of the tray 1 when the two end sealers 35 and 36 mesh with each other, that is, when the upper end sealer 35 lies at its lowermost position as shown in FIG. 6.

While in this embodiment the end seal unit 5 and the film press member 43 are formed as a unitary structure as mentioned above, it is a matter of course that they may be provided separately.

Downstream of the film press member 43 is the shrinking tunnel 10, which is usually open at opposite ends and has an inverted U-shaped cross sectional configuration. Provided immediately below the shrinking tunnel 10 is a conveyor belt 45 which conveys each intermediate package 46 cut away from the tubular film 7' by the end seal unit 5. Near the discharge end of the conveyor belt 45 is provided a take-away conveyor 48, by which is taken away a shrink package 50 that has been thermally shrunk by passage through the shrinking tunnel 10.

Next, description will be made of the operation of the apparatus described above. At first, the web of wrapping film 7 is continuously pulled out from the reel 8 and is guided to the bag making unit 14 without being perforated and whereat the film 7 is formed into the tubular film 7'. On the other hand, the articles 3 are pushed by the fingers 19 and sequentially fed into the tubular film 7' at predetermined intervals.

The articles 3 within the tubular film 7' are conveyed intact by the second conveyor 16, while at the same time the overlapping marginal portions 7*a* of the tubular film 7' extending lengthwise thereof are heat sealed by the center seal unit 20 while being gripped between the heating roller 21 and the rollers 22.

Figure 7:
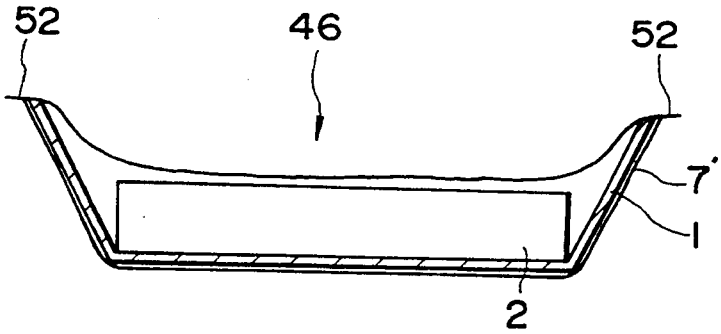
FIG. 7 is a side view illustrating an intermediate package formed in the present invention.

Downstream of the center seal unit 20 the tubular film 7' is heat sealed and cut by the end seal unit 5 along the transverse side of each article 3 at predetermined intervals to form the individual intermediate packages 46. Prior to the end sealing of each article, at the rear end thereof the tubular film 7' is depressed inwardly thereof by the press member 43 as shown in FIG. 5. Then the end sealers 35 and 36 are moved into engagement with each other to perform end sealing as shown in FIG. 6, thus providing the intermediate package 46 with the top of the tubular film 7' thereof depressed as depicted in FIG. 7. Thereby, the quantity of air in the intermediate package 46 is reduced. Shrinkage allowance of the tubular film 7' is provided taking into account thermal shrinkage thereof.

Since the film press member 43 is made of sponge, the item 2 in the tray 1, even if hit by the underside of member 43, will not be injured and the tubular film 7' can be deformed downwardly. Hence, when the thickness of the sponge portion is greater than the thickness illustrated, the film press member 43 moves down while being partly urged against the item 2, by which the tubular film 7' around the item 2 can be pressed down below the top surface of the item 2.

Figure 8:
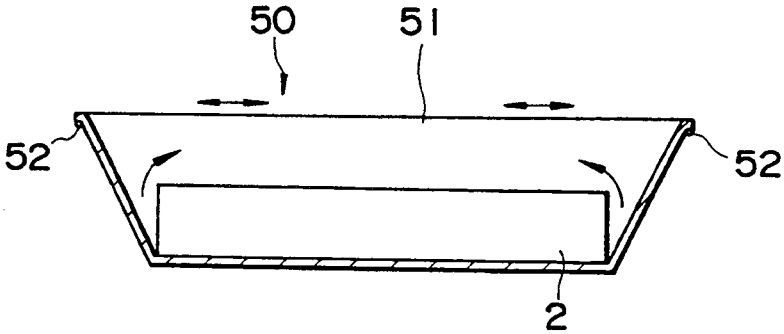
FIG. 8 is a side view illustrating a shrink package of the present invention which is formed by passing the intermediate package of FIG. 7 through a shrinking tunnel.

Then, the intermediate package 46 is fed into the shrinking tunnel 10 via the endless belt 40 and the conveyor 45. Since the temperature in the shrinking tunnel 10 is particularly higher at the upper side, the tubular film 7' shrinks greatly at the upper side of the tray 1, and hence the tubular film 7' lying in the opening of the tray 1 becomes taut as shown in FIG. 8. In this instance, the air in intermediate package 46 is thermally expanded but the tubular film 7' does not swell upwardly of the upper edge of the tray 1, because the air flows into the upper space 51 which is newly defined as the top surface of the tubular film 7′ rises.

As the result of this phenomenon, the tubular film 7′ thermally shrinks into close contact with the tray 1 to form the shrink package 50. The shrink package 50 thus formed is a completely sealed bag with no perforations and gas permeability of the film material is low. Accordingly the shrink-wrapped item 2 can be preserved in good condition.

The preservation of the shrink-wrapped item 2 can be further ensured by sealing an inert gas in the package 50. It is preferable to employ such an arrangement as schematically shown in FIG. 1. That is, one end of a small-diametered pipe 60 is connected to an inert gas supply source 61 such as an inert gas cylinder. The other end portion of the pipe 60 is inserted into the tubular film 7′ through an open front end of the bag making unit 14 at the upper portion thereof in a manner not to hinder the conveyance of the individual articles to be wrapped. The tip of the inserted end portion of the pipe 60 is opened toward the direction of advance of the tubular film 7′ at a position where it will not interfere with the end seal unit 5. This permits sealing of nitrogen gas or like inert gas in the package while retaining the feature of the shrink package, and hence makes it possible to prevent the wrapped item from deterioration.

With the end seal unit 5 used in the above apparatus, a coiled spring (not shown) is provided in the upper sealer 35 to hold its film gripping portion lower than the normal film holding position so that when the two sealers 35 and 36 mesh with each other to grip the tubular film 7′ therebetween, the lower sealer 36 pushes up the upper sealer 35 at the film gripping portion against the coiled spring to apply a predetermined pressure to the tubular film 7′ by the reaction force of the coiled spring. With this structure, the film holding force is obtained by the coiled spring alone, and hence its compressive force must be large. Accordingly, a motor of a large capacity is needed to drive the two sealers 35 and 36 against the large compressive force of the coiled spring. Also, the sealers 35 and 36 make a noisy metallic sound each time their film gripping portions bump against each other.

Figure 9:
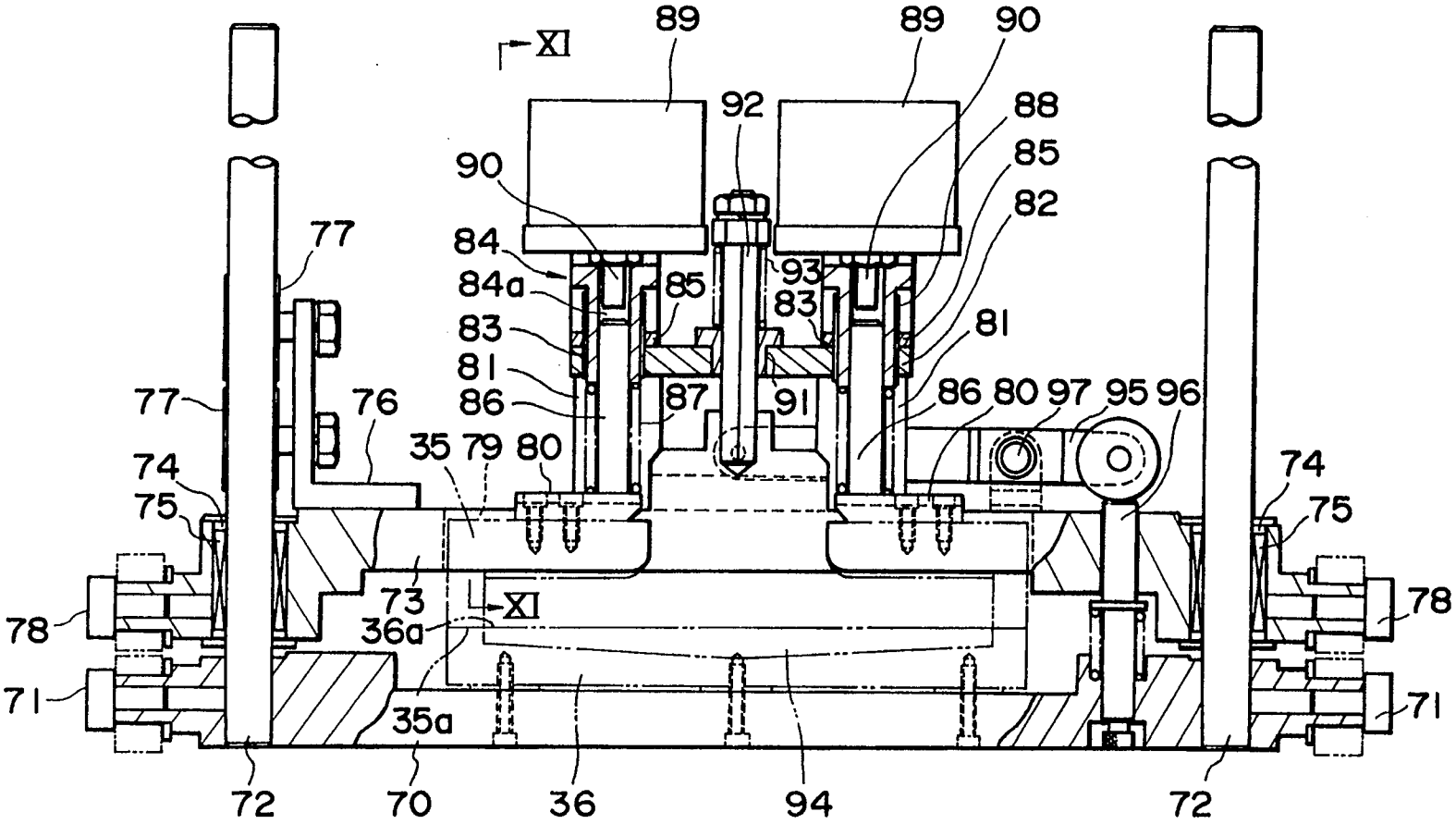
FIG. 9 is a front view, partly in section, of a preferable end seal unit for use in the present invention.
Figure 10:
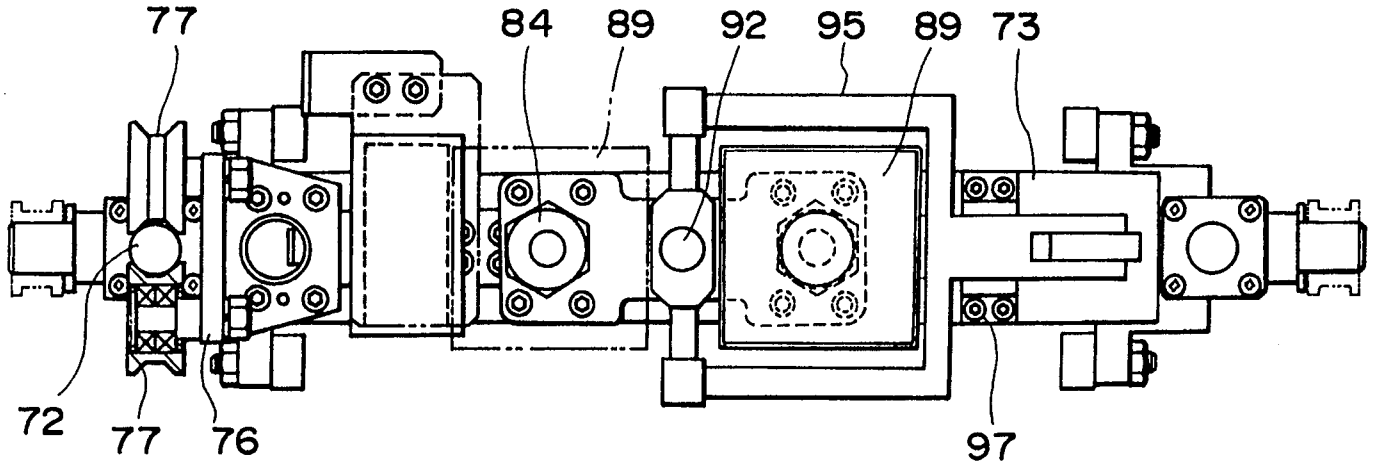
FIG. 10 is a plan view of the end seal unit depicted in FIG. 9.
Figure 11:
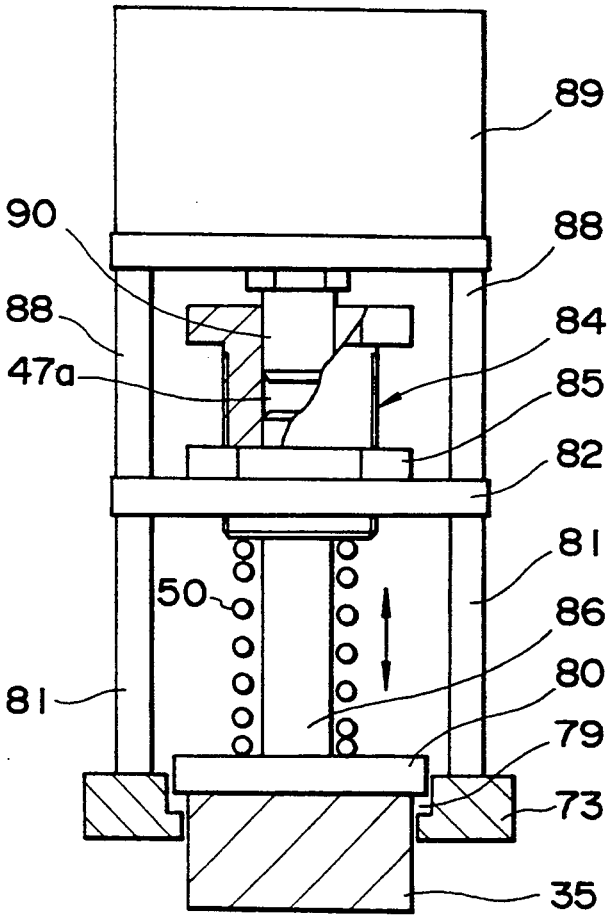
FIG. 11 is a sectional view taken on the line XI—XI in FIG. 9.

FIGS. 9 through 11 illustrate an end seal unit suitable for use in the present invention. This end seal unit is also of the box motion type as in the above embodiment and has a construction in which the upper and lower sealers 35 and 36 disposed opposite across the tubular film 7′ move along paths as indicated by the one-dot-chain lines in FIG. 1 while always maintaining their end faces 35*a* and 36*a* in positions opposed to each other. That is, the sealers 35 and 36 move in parallel with the conveyance of the tubular film 7′ over a certain section while gripping a predetermined portion of the tubular film 7′ between their end faces 35*a* and 36*a*.

The mechanism for driving the sealers 35 and 36 is as depicted in FIGS. 9 to 11. At a predetermined position below the tubular film 7′ is disposed an elongated flat lower support bed 70 extending perpendicularly to the direction of travel of the tubular film 7′. The lower support bed 70 is movable back and forth and up and down. On the top of the lower support bed 70 is fixedly mounted the lower end sealer 36. The lower support bed 70 has attached to opposite ends thereof disc-shaped cam followers 71, which engage grooved cams (not shown) to control the movement of the lower support bed 70 so that the lower sealer 36 moves along the predetermined path.

Extending upwardly from opposite ends of the lower support bed 70 are upright a pair of guide rods 72 which are adapted to move in synchronism with the movement of the lower support bed 70. An elongated flat upper support bed 73 is mounted on the guide rods 72 in a manner to be slidable along axes thereof. More specifically, the guide rods 72 are inserted through bearings 75 held in through holes 74 made in the upper support bed 73 at predetermined positions at opposite ends thereof. Further, an L-shaped bracket 76 is mounted on the top of the upper support bed 73 at one end thereof and two pairs of rollers 77 are disposed vertically on the outer side surface of the L-shaped bracket 76 in such a manner that each pair of rollers 77 hold therebetween one of guide rods 72. That is, this example is designed so that the upper support bed 73 can be moved up and down stably by one bearing 75 and the four rollers 77 associated with the respective guide rod 72. Also, the upper support bed 73 has attached thereto at opposite ends thereof cam followers 78 so that the upper support bed 73 is moved along the predetermined path defined by grooved cams (not shown) as is the case with the lower support bed 70.

The upper support bed 73 has a rectangular opening or window portion 79 vertically extending therethrough centrally thereof, and the upper sealer 35 is disposed in the window portion 79. The upper sealer 35 moves with the rotational movement of the upper support bed 73 and, at the same time, moves up and down with predetermined travel relative to the upper support bed 73. As shown in FIG. 11, flat coupling plates 80 are mounted on the upper sealer 35 at predetermined positions. The width of each coupling plate 80 is selected larger than the width of the window portion 79 of the upper support bed 73. Accordingly, the coupling plates 80 engage the window portion 79 to prevent the upper sealer 35 from falling through the upper support bed 73.

Two pairs of side walls 81 extend along marginal edges of the upper support bed 73 lengthwise thereof, and a top panel 82 is mounted on each pair of side walls 81. The top panel 82 has tapped holes 83 at opposite ends thereof, into which are screwed bolts 84 each having a through hole 84*a*. Each bolt 84 has thereon a jam nut 85. Guide pins 86 mounted on the coupling plates 80 are inserted into respective through holes 84*a* of the bolts 84, and by vertical movement of the guide pins 86 guided by the through holes 84*a*, the upper sealer 35 is also moved up and down relative to the upper support bed 73.

Around each guide pin 86 there is disposed a coiled spring 87 which serves as first urging means, and upper and lower end portions of the coiled spiring 87 abut against the lower end of the bolt 84 and the coupling plate 80, respectively. The upper sealer 35 is urged downwardly by the elastic restoring force of the coiled springs 87. In this example, the urging force of the coiled springs 87 can be controlled by moving up and down the bolts 84. Incidentally, in this example the urging force (i.e., the elastic restoring force) of the coiled springs 87 is set to a minimum value with a view to reducing the force which is applied to the two sealers 35 and 36 when their end faces 35*a* and 36*a* bump against each other.

On the top panel 82 are mounted support plates 88 in alignment with the side walls 81 for supporting air cylinders 89 which are used as second urging means. A cylinder rod 90 of each air cylinder 89 is received in the through hole 84*a* of the bolt 84 so that when the cylinder rod 90 is extended, its tip end portion abuts against the guide pin 86 to push it down.

The top panel 82 has a centrally disposed hole 91, through which is inserted an actuating rod 92 in a manner to be movable up and down. The actuating rod 92 is always urged upwardly by a spring 93 disposed around rod 92. A cutter 94 is suspended from the lower end of the actuating rod 92 and is incorporated in the upper sealer 35. The lower end of the actuating rod 92 has connected thereto one end of a rocking lever 95, the other end portion of which is disposed on the upper support bed 73 in a manner to be movable up and down and has its extremity resting on a push-up pin 96 extending through the upper support bed 73. As the pin 96 goes up, the outer end of the rocking lever 95 is urged upwardly, by which the rocking lever 95 is turned about a supporting point 97 and its inner end, and consequently the cutter 94, is lowered to protrude downwardly from the end face 35*a* of the upper sealer 35 as shown. On the other hand, when the push-up pin 96 moves down, the upward urging force acting on the outer end of the rocking lever 95 is removed and the actuating rod 92, and consequently the cutter 94, is moved upwardly by the elastic restoring force of the spring 93 and enters into the upper sealer 35.

Next, description will be made of the operation of the end seal unit 5. When the end faces 35*a* and 36*a* of the two sealers 35 and 36, moving along a predetermined path, abut or bump against each other with the tubular film 7' gripped therebetween, the tubular film 7' is pressed with a predetermined pressure and is heated at the same time. In this example, since the elastic restoring force of the coiled springs 87 is set small as referred to previously, the reaction force caused between the sealers 35 and 36 when their end faces bump against each other is small. Consequently, the two end faces 35*a* and 36*a* are smoothly brought by relatively small force into contact with each other with the tubular film 7' gripped therebetween. However, the film gripping force between the sealers 35 and 36 due to the coiled spring 87 cannot provide the tubular film 7' with sufficient sealing strength.

Thereafter, the sealers 35 and 36 move forwardly while holding the tubular film 7' therebetween. At this time the air cylinders 89 are activated to extend their cylinder rods 90, by which the guide pins 86 are pressed down. As a consequence, the upper sealer 35 connected to the guide pins 86 is also urged downwardly, by which the lower sealer 36 is urged down. By the reaction force which is caused by the lower sealer 36 at that time, a pressure for obtaining desired sealing strength of the tubular film 7' is generated between the sealers 35 and 36. The urging force from the air cylinders 89 is applied to the both sealers 35 and 36 while they are abutted against each other. Hence, even if the urging force is large, the sealers 35 and 36 are not damaged and noise is not generated. In this way, the tubular film 7' is heat sealed without fail. Simultaneously with such heat sealing, the cutter 94 is brought down, by which the tubular film 7' is severed along the heat-sealed portion to form the intermediate package. The air cylinders 89 are activated when it is detected by a limit switch or similar sensors that the upper and lower sealers 35 and 36 engage each other.

Although in the above the article 3 to be wrapped 3 is stored in the tray 1, the present invention is not limited specifically thereto and the tray 1 need not necessarily be used. Further, in the above embodiment the height of the tray 1 is larger than the height of the item 2 to be wrapped, but this relationship also may be reversed.

Needless to say, the film is not limited specifically to that used in the above embodiment, and its thermal shrinkage factor is determined taking into account the sizes and shapes of the item to be wrapped and the tray and the relationship between the gas containing volume in the intermediate package and that in the ultimate shrink package.

Moreover, while in the above the end seal unit has been described to be of the box motion type, it may also be of a rotary type in which the upper and lower sealers rotate about rotary shafts, and the other units and components are not limited specifically to those described above.

It will be apparent that many modifications and variations may be effected without departing from the scope of the novel concepts of the present invention.

What is claimed is:

1. A wrapping apparatus comprising:

means for continuously supplying a wrapping film made of a material having excellent thermal bonding properties;

means for shaping said film into a tubular form;

means for feeding into said tubular film individual items to be wrapped;

center seal means, provided in a path of conveyance of said tubular film, for sealing overlapping marginal portions of said tubular film extending lengthwise thereof; and end seal means, disposed downstream of said center seal means, for sealing and cutting said tubular film transversely thereof at predetermined intervals;

wherein said end seal means includes a pair of upper and lower sealers conducting a box type movement, at least one of said upper and lower sealers has first urging means for generating an urging force relatively weakly pressing end faces of said upper and lower sealers into contact with each other with the film gripped therebetween when said upper and lower sealers are closest to each other, and second urging means for applying between said end faces of said upper and lower sealers an urging force larger than that by said first urging means when said end faces are pressed against each other by said first urging means.

2. A wrapping apparatus as claimed in claim 1, wherein said first urging means is a coil spring and said second urging means is a fluid cylinder.

3. A wrapping apparatus as claimed in claim 1, wherein said center seal means comprises at least one disc having plural annular projections formed around a peripheral surface thereof.

* * * * *